US006493901B1

(12) United States Patent
Jones

(10) Patent No.: US 6,493,901 B1
(45) Date of Patent: Dec. 17, 2002

(54) PAINT TRAY UTENSIL HOLDER

(76) Inventor: Ulysses Jones, 38 Inglewood Dr., Rochester, NY (US) 14619

( * ) Notice: Subject to any disclaimer, the term of this patent is extended or adjusted under 35 U.S.C. 154(b) by 0 days.

(21) Appl. No.: 09/897,378

(22) Filed: Jul. 2, 2001

(51) Int. Cl.[7] ..... B44D 3/12; B65D 25/00
(52) U.S. Cl. ..... 15/257.06; 220/570
(58) Field of Search ..... 15/257.05, 257.06; 220/570, 697

(56) References Cited

U.S. PATENT DOCUMENTS 3,087,190 A * 4/1963 Werner
4,025,205 A 5/1977 Hawk
4,167,348 A 9/1979 Hawk
4,233,705 A * 11/1980 Lepage
4,275,818 A * 6/1981 Church
4,721,225 A * 1/1988 Sobel
4,890,353 A 1/1990 Shannon et al.
5,038,955 A * 8/1991 Studer
5,472,111 A * 12/1995 Renfrew
5,509,169 A 4/1996 Drucker

* cited by examiner

*Primary Examiner*—Randall E. Chin
(74) *Attorney, Agent, or Firm*—Donald K. Jones

(57) ABSTRACT

The present invention relates to a device for supporting paint utensils used during painting, and more particularly relates to a utensil holder that may be secured to a paint tray for supporting a paint roller, paintbrush, paint wheel or the like when not in use. In addition, the present invention efficiently holds the handle of paint utensil in a convenient orientation for quick access.

13 Claims, 4 Drawing Sheets

PAINT TRAY UTENSIL HOLDER

BACKGROUND OF THE INVENTION

The present invention relates to a device for supporting paint utensils used during painting, and more particularly relates to a utensil holder that is releasably secured to a paint tray for supporting a paint roller, paintbrush, paint wheel or the like when not in use.

During the painting process, the need often arises to alternate utensils, such as, paint rollers or paintbrushes in order to appropriately paint a specified area. Considering that these tools will be alternated a number of times throughout the painting process, a convenient resting location for the utensil that is not in use is very desirable. While a utensil holder may provide a resting location, preferably, the holder is either permanently secured to a paint tray or can be easily releasably secured to the paint tray. It is desirable for the utensil holder to be positioned as to allow excess paint from the utensil not in use, to drain into the paint reservoir of the paint tray. In addition, the location for the utensil holder must allow access to the paint reservoir for the utensil that is in use. Furthermore, it is also desirable for the utensil holder to position the resting utensil in a convenient orientation to minimize wasted time and motion while alternating utensils.

Several inventions have been disclosed in U.S. Patents that have attempted to address the problems associated with holding paint utensils, however, they do not provide solutions that incorporate many of the desirable features. For instance U.S. Pat. No. 4,890,353 to Shannon, et al., entitled, "Paint Brush and Paint Roller Holder", discloses a paint brush holder that is cumbersomely bolted to the end wall of a paint tray. While the holder can support a paintbrush, if it is of a length longer than the spaced apart support members, the handle of the paint brush can only rest in one possible orientation (parallel to the end wall of the paint tray). A paint roller placed in the support members will only allow the handle to be positioned outside of the paint tray in an awkward position. Consequently, any paint that may accumulate on the paint roller handle will not be contained or drain within the paint tray.

Another invention in U.S. Pat. No. 5,509,169 to Drucker, entitled, "Paint Tray with Paint Brush Holder", discloses a paint tray that has protrusions or cut outs within the side and end walls which allows a paintbrush to be positioned at an angle supported by the tray walls. While this type of support will hold a paintbrush, the support does not allow excess paint to drain into the paint tray. In addition, a paint roller supported in this manner will have the handle oriented outside the paint tray, with any excess paint draining outside the paint tray.

SUMMARY OF THE INVENTION

In accordance with one aspect of the present invention, there is provided a paint tray assembly comprising a conventional rectangular paint tray and a paint utensil holder. The paint tray, generally, has two opposing side walls, a front wall, an upright end wall and a base in which a portion of the base inclines from the end wall to the front wall. Adjacent to the upright end wall the rectangular portion of the tray defines a paint reservoir. The paint utensil holder has an elongated platform with first and second legs connected to first and second ends of the elongated platform and the lower ends of the legs are adapted to be secured to the edges of a paint tray. Located at an intermediate section between the two ends of the elongated platform there is a handle support member. When the attached legs of the elongated platform are secured to the paint tray edges, the elongated platform is suspended above the paint reservoir.

In accordance with another aspect of the present invention, there is provided, a paint tray assembly having a conventional paint tray and a paint utensil holder. The paint utensil holder includes an elongated platform formed as an open framework with attached legs at each end of the elongated platform. When positioned above the paint reservoir of a paint tray, the open framework of the elongated platform allows the excess paint from a paint roller positioned on the platform to drain into the paint reservoir.

In accordance with another aspect of the present invention, there is provided, a paint tray assembly having a conventional paint tray and a paint utensil holder. The paint utensil holder includes an elongated platform formed as an open framework with attached legs at each end of the elongated platform. The elongated platform has an arced shaped that is capable of receiving the roller head of a paint roller.

In accordance with yet another aspect of the present invention, there is provided, a paint tray assembly having a conventional paint tray and a paint utensil holder. The utensil holder is formed of plastic.

In accordance with yet another aspect of the present invention, there is provided, a paint tray assembly having a conventional paint tray and a paint utensil holder. The utensil holder is formed of metal.

In accordance with another aspect of the present invention, there is provided, a paint tray assembly having a conventional paint tray and a paint utensil holder. The utensil holder is formed of metal.

In accordance with one aspect of the present invention, there is provided, a paint tray assembly comprising a conventional rectangular paint tray and a paint utensil holder. The paint utensil holder has an elongated platform with first and second legs connected to first and second ends of the elongated platform and the lower ends of the legs are adapted to be secured to the edges of a paint tray. Located at an intermediate section between the two ends of the elongated platform there is a handle support member. The elongated platform, the platform legs and the handle support member are integrally formed.

In accordance with one aspect of the present invention, there is provided a paint utensil holder having an elongated platform with first and second legs connected to first and second ends of the elongated platform and the lower ends of the legs are adapted to be secured to the edges of a conventional paint tray. Located at an intermediate section between the two ends of the elongated platform there is a handle support member. When the attached legs of the elongated platform are secured to the paint tray edges, the elongated platform is suspended above the paint reservoir of the paint tray.

In accordance with another aspect of the present invention, there is provided a paint utensil holder that includes an elongated platform formed as an open framework with attached legs at each end of the elongated platform. When the paint utensil holder is positioned above the paint reservoir of a paint tray, the open framework of the elongated platform allows the excess paint from a paint roller positioned on the platform to drain into the paint reservoir.

In accordance with another aspect of the present invention, there is provided a paint utensil holder that includes an elongated platform formed as an open framework with attached legs at each end of the elongated platform. The elongated platform has an arced shaped that is capable of receiving the roller head of a paint roller.

In accordance with yet another aspect of the present invention, there is provided a paint utensil holder that is formed of plastic.

In accordance with yet another aspect of the present invention, there is provided a paint utensil holder that is formed of metal.

In accordance with another aspect of the present invention, there is provided a paint utensil holder. The paint utensil holder has an elongated platform with first and second legs connected to first and second ends of the elongated platform and the lower ends of the legs are adapted to be secured to the edges of a paint tray. Located at an intermediate section between the two ends of the elongated platform there is a handle support member. The elongated platform, the platform legs and the handle support member are integrally formed.

DETAILED DESCRIPTION OF THE INVENTION

Figure 1:
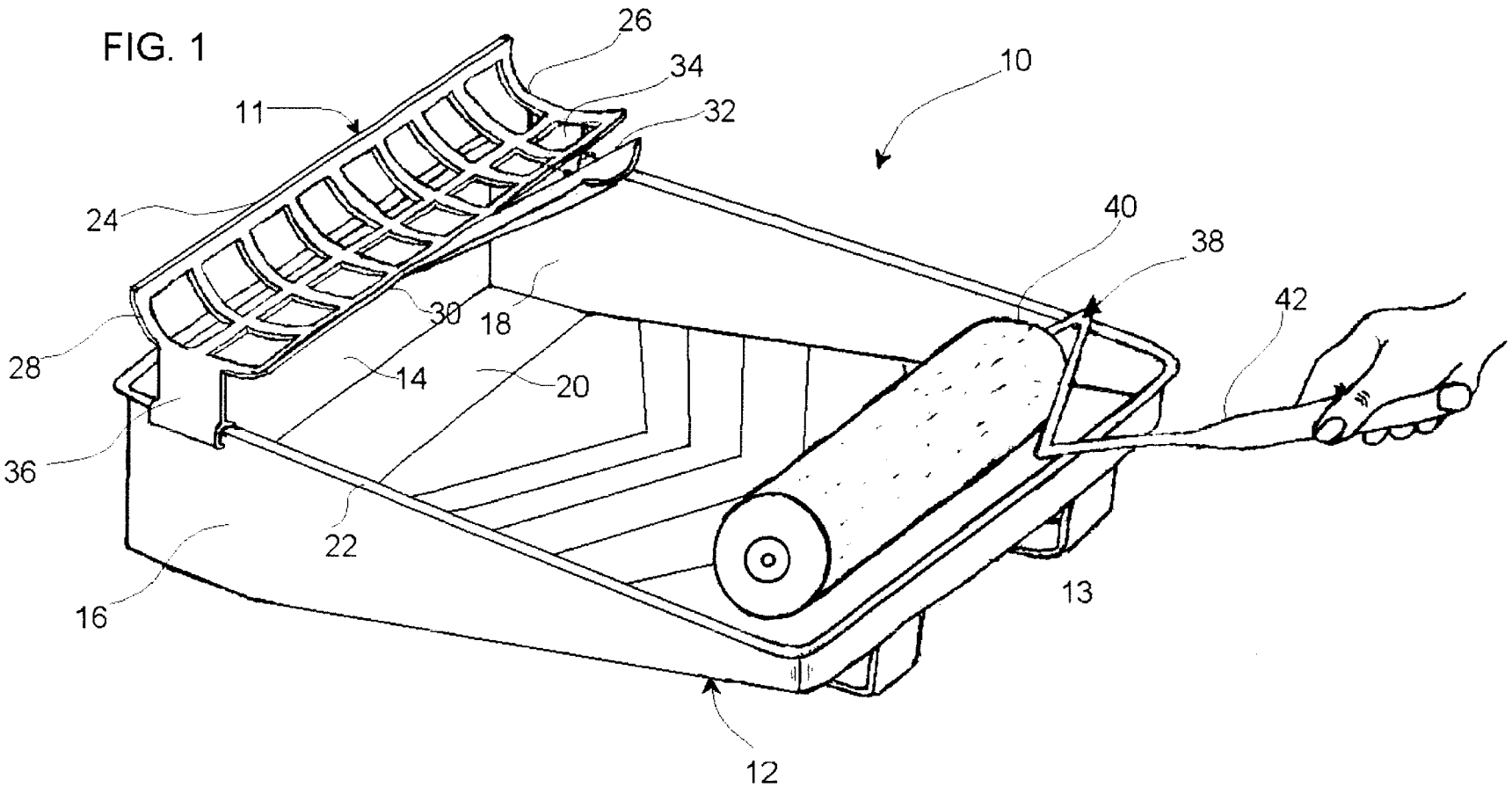
FIG. 1 is a perspective view of a preferred embodiment of the invention.

FIG. 1 illustrates generally, a paint tray assembly 10 having a utensil holder 11 and a paint tray 12. Paint tray 12 is of a conventional type, having a front wall 13, an upright end wall 14, two opposing side walls 16 and 18 and a paint reservoir 20 adjacent to end wall 14. Paint reservoir 20 has a base that extends from the upright end wall 14 to the front wall 13. A portion of the base of the paint reservoir 20 inclines as it extends to the front wall. Along the top of the walls of paint tray 12, there is a tray edge 22.

The paint utensil holder 11, includes an elongated platform 24, that is generally positioned between the two side walls 16 and 18 of paint tray 12. The elongated platform 24 has a first platform end 26, a second platform end 28 and an intermediate section 30, located between the first and second platform ends. Connected to the intermediate section 30 is a utensil handle support member 32. Preferably, a portion of the utensil handle support member is arced, which adequately and conveniently holds the handle of a paint utensil, such as a paint brush or paint roller. The elongated platform 24 also has a first leg 34 connected to the first platform end 26 and a second leg 36 connected to the second platform end 28. The lower ends of the first and second legs 34 and 36 are adapted to engage paint tray edge 22.

As can be seen in FIG. 1, when the first and second legs 34 and 36 are positioned on tray edge 22, the elongated platform 24 is suspended above paint reservoir 20. The elongated platform 24 has an open framework structure. The open framework structure allows excess paint from a paint utensil, such as, a paint roller, paint brush, paint wheel or sponge to drain into the paint reservoir 20, when the utensil is positioned on the elongated platform 24 of paint utensil holder 11. Also shown in FIG. 1 for illustrative purposes is a paint roller 38 having a roller head 40 and a roller handle 42.

Figure 2:
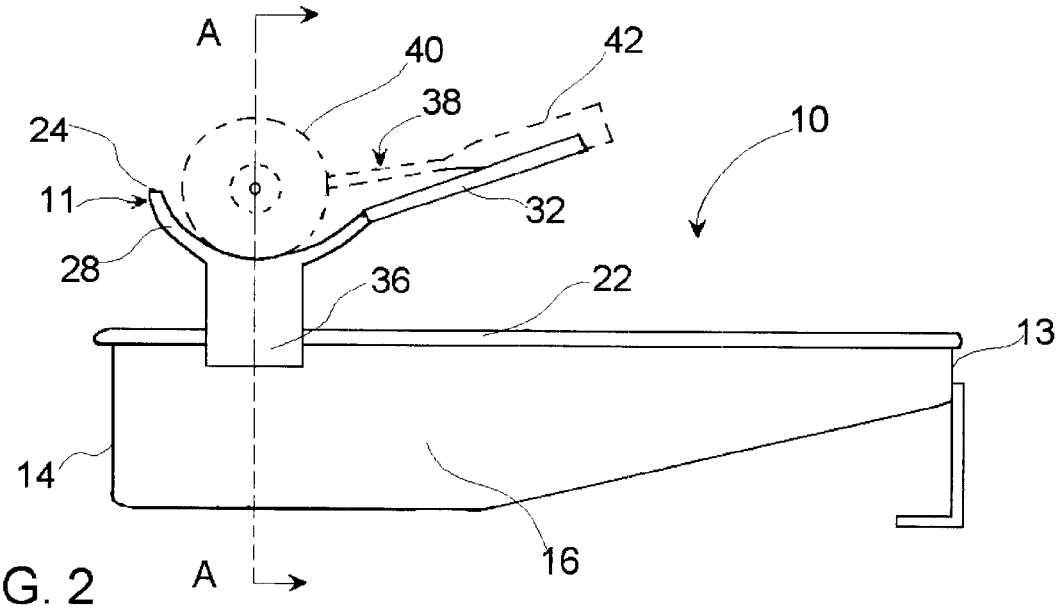
FIG. 2 is a side view of the invention in FIG. 1 with a paint roller shown in phantom.

FIG. 2 depicts a side view of paint tray assembly 10. This drawing includes paint roller 38, shown in phantom, positioned on paint utensil holder 11. As can be seen from the view, the second platform end 28 indicates an arced profile for elongated platform 24. The arced shape of elongated platform 24 is used to stabilize roller head 40 of paint roller 38, when positioned on paint utensil holder 11. When paint roller 38 is properly positioned on paint utensil holder 11, roller handle 42 will rest on utensil handle support member 32. The general orientation of roller handle 42 is at an upward angle towards the direction of front wall 13, providing convenient access by the painter.

Figure 2A:
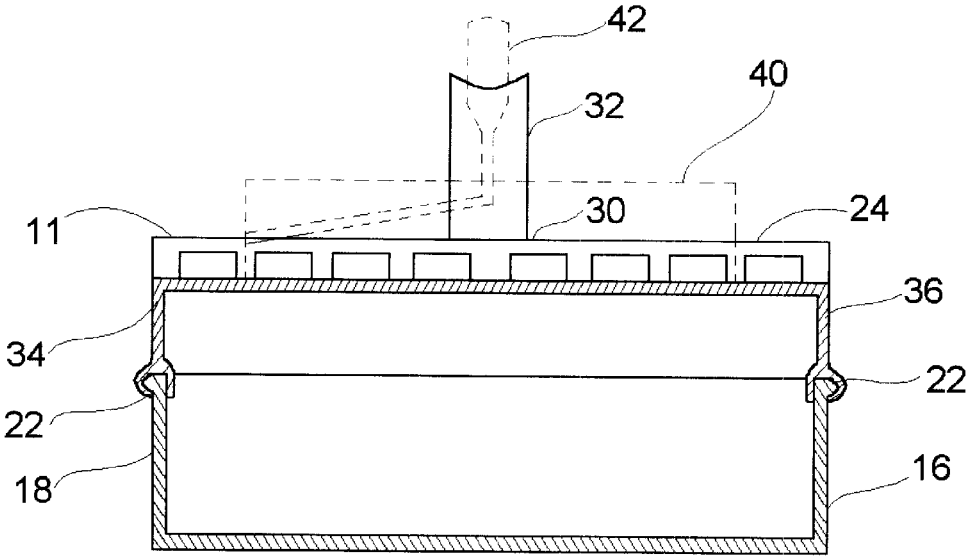
FIG. 2A is a partial section view in the direction of arrows A—A with the paint roller shown in phantom.

FIG. 2A shows a cross sectional view of the paint tray assembly 10 in the direction of arrows A—A. The drawing depicts the lower ends of the first and second legs, 34 and 36, engaging the paint tray edge 22. The legs are releasably secured by interlock around the flanged design of tray edge 22. As shown, the legs of the utensil holder 11, suspend the elongated platform 24 above tray edge 22. The raised elongated platform 24 allows easy access to paint reservoir 20 with the paint roller or other utensils. In a preferred embodiment, the paint utensil holder 11 is formed of a molded plastic. Several suitable plastics include polystyrene, nylons, and polyolefins with a preferred plastic being nylon. In a preferred embodiment, the molded plastic paint utensil holder includes an elongated platform, legs and utensil handle support member all formed of integral construction. This can be accomplished using standard injection molding techniques or by plastics thermoforming.

Figure 3:
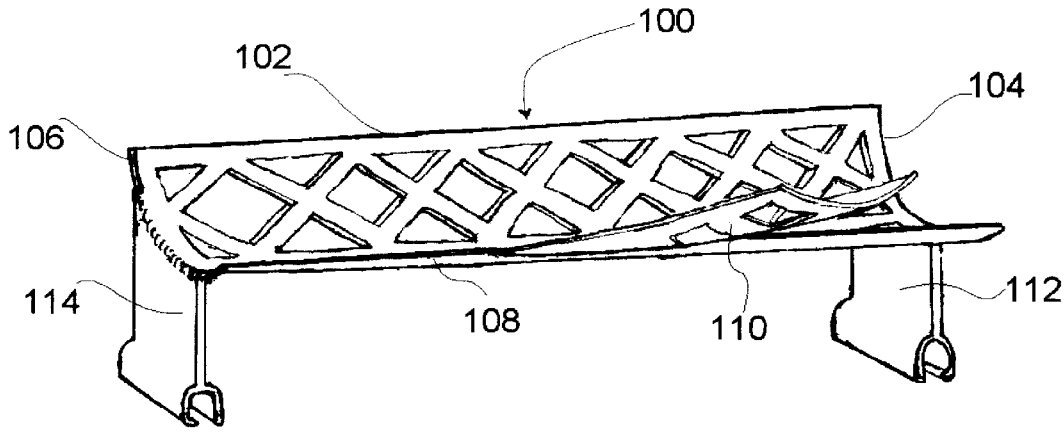
FIG. 3 is a perspective view of one embodiment of the invention.

FIG. 3 illustrates another embodiment, in which the paint utensil holder 100 is integrally molded. The elongated platform 102 is of an open framework allowing excess paint from a resting utensil to drain into a paint reservoir when the paint utensil holder is positioned on a paint tray. Elongated platform 102 has first and second platform ends 104 and 106 and an intermediate section 108 located between the ends. A utensil handle support member 110 is integrally connected to the intermediate section 108. A first leg 112 and a second leg 114 are integrally molded to the first and second platform ends 104 and 106. Utensil handle support member 110 is also of an open framework.

Figure 4:
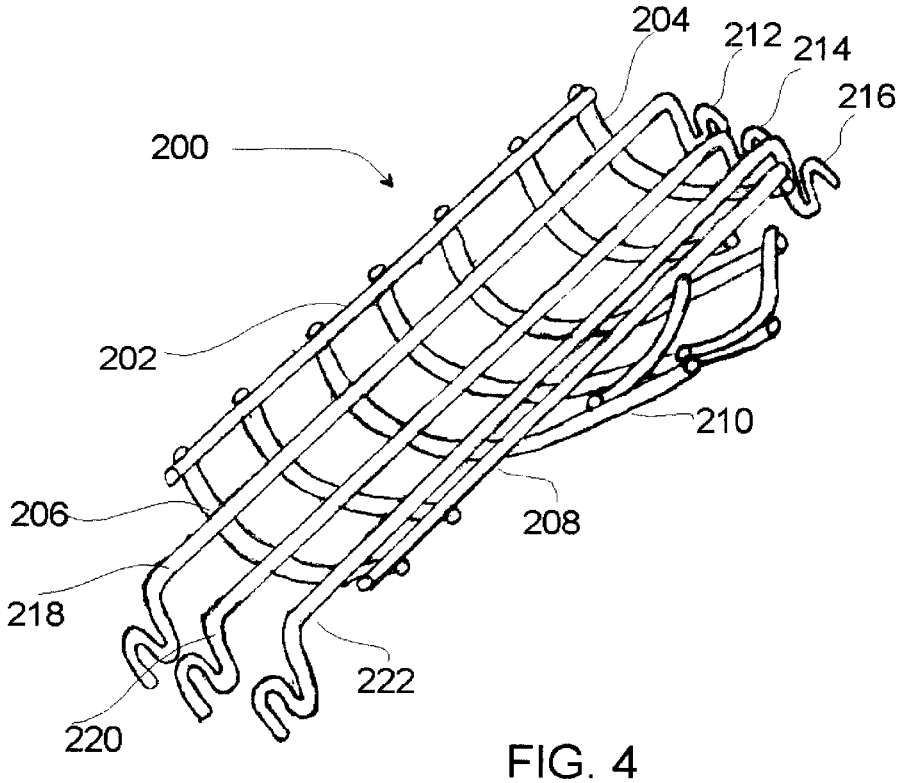
FIG. 4 is a perspective view of another embodiment of the invention.

FIG. 4 illustrates yet another embodiment, in which the paint utensil holder 200 is formed from a wire framework. Suitable materials for the framework include plastic coated wire or hardware cloth, as well as, perforated metal sheeting. The paint utensil holder 200 has an elongated platform 202. Elongated platform 202 has first and second platform ends 204 and 206 and an intermediate section 208 located between the ends. A utensil handle support member 210 is integrally connected to the intermediate section 208. A first leg 212, a second leg 214 and a third leg 216 are integrally connected to the first platform end 204. A fourth leg 218, a fifth leg 220 and a sixth leg 222 are integrally connected to the second platform end 206. Utensil handle support member 210 is also of an open framework preferably formed from the same material as the elongated platform 202. As can be appreciated, the number of legs extending from the elongated platform can vary as needed, based on the number of wires used in the platform. All of the legs for utensil holder 200 have a lower portion that is adapted to engage the tray edge of a paint tray and support the elongated platform 202 above a paint reservoir.

Figure 5:
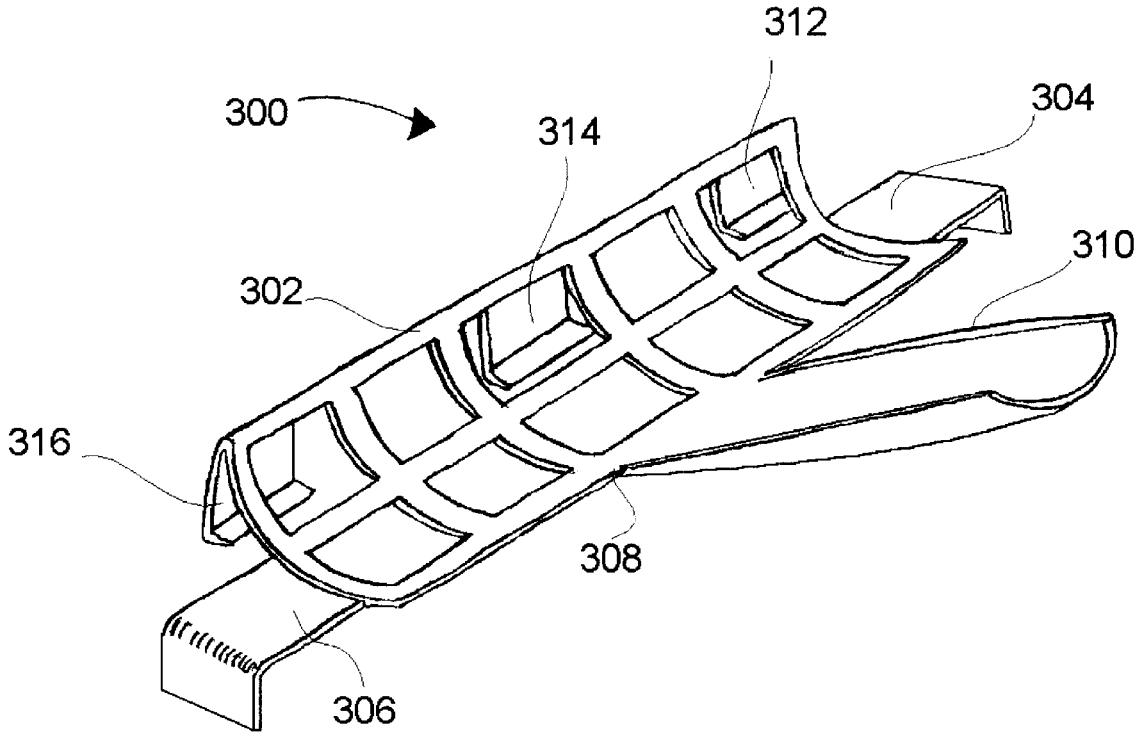
FIG. 5 is a perspective view of still another embodiment of the invention.

FIG. 5 illustrates still another embodiment, in which the paint utensil holder 300 is integrally molded. The paint utensil holder 300 has an elongated platform 302. Elongated platform 302 has a first end section 304, a second end section 306 and an intermediate section 308 located between the first and second end sections. A utensil handle support member 310 is integrally connected to the intermediate section 308. Connected to the edge of elongated platform 302, opposing the utensil handle support member 310 are first, second and third legs 312, 314, and 316. The first end section 304 and the second end section 306 have ends that are adapted to rest on the tray edges of the side walls of a paint tray. The distance between the first end section 304 and the second end section 306 is roughly about the width of the paint tray. The first, second and third legs 312, 314 and 316 have a lower portion that is adapted to engage the flanged tray edge of an upright end wall of a paint tray.

The foregoing is a description of several practical embodiments of the present invention. Numerous changes and variations may be made thereto without departing from the spirit and scope of the invention.

That which is claimed is:

1. A paint tray assembly having a paint utensil holder for suspending a paint roller, paint brush or the like, above the paint reservoir of the paint tray comprising:

a paint tray, which takes the form of a generally rectangular box, having an upright end wall, a front wall, two side walls and a rectangular partially inclined base defining a paint reservoir adjacent to said upright end wall;

an elongated platform member having a first end, a second end and an intermediate section located between said first and second ends, wherein said elongated platform is substantially non-flat;

a handle support member having a generally rectangular shape, further having a first end and a second end, said first end of said handle support member being connected to said intermediate section of said elongated platform member;

at least two legs each having upper and lower ends, where said upper end of a first leg is connected to said first end of said elongated platform member and said upper end of a second leg is connected to said second end of said elongated platform member, said lower ends of said first and second legs are adapted to engage the edges of a paint tray, such that when the lower ends of said legs are connected to the edges of a paint tray adjacent to the paint reservoir, said elongated platform member is suspended above the paint reservoir of the paint tray.

2. A paint tray assembly as defined in claim 1, wherein said lower end of at least two legs are secured to said paint tray.

3. A paint tray assembly as defined in claim 2, wherein said elongated platform member takes the form of an open framework.

4. A paint tray assembly as defined in claim 3, wherein said elongated platform member is arced.

5. A paint tray assembly as defined in claim 3, wherein said elongated platform member and said handle support member are integrally molded.

6. A paint utensil holder for suspending a paint roller above the paint reservoir of a paint tray comprising:

an elongated platform member having a first end, a second end and an intermediate section located between said first and second ends, wherein said elongated platform is substantially non-flat;

a handle support member having a generally rectangular shape and further having a first end and a second end, said first end of said handle support member being connected to said intermediate section of said elongated platform member;

at least two legs each having upper and lower ends, where said upper end of a first leg is connected to said first end of said elongated platform member and said upper end of a second leg is connected to said second end of said elongated platform member, said lower ends of said first and second legs are adapted to engage the edges of a paint tray, such that when the lower ends of said legs are attached to the edges of a paint tray adjacent to the paint reservoir, said elongated platform member is suspended above the paint reservoir of the paint tray.

7. A paint utensil holder as defined in claim 6, wherein said elongated platform member takes the form of an open framework.

8. A paint utensil holder as defined in claim 7, wherein said elongated platform member is arced.

9. A paint utensil holder as defined in claim 8, wherein said elongated platform member and said handle support member are integrally molded.

10. A paint utensil holder as defined in claim 7, wherein said elongated platform member and said handle support member are intergrally molded.

11. A paint utensil bolder for suspending a paint utensil above the paint reservoir of a paint tray comprising:

an elongated platform member having a first end section a second end section and an intermediate section located between said first and second end sections, wherein said elongated platform member is substantially non-flat and said first and second end sections are adapted to engage the side walls of a paint tray;

a handle support member having a generally reangular shape and further having a first end and a second end, said first end of said handle support member being connected to said intermediate section of said elongated platform member;

at least one leg, having an upper portion and a lower portion, wherein said upper portion is connected to said elongated platform member opposing said handle support member and said lower portion is adapted to engage the edge of an upright end wall of a paint tray.

12. A paint utensil holder as defined in claim 11, wherein said elongated platform member takes the form of an open framework.

13. A paint utensil holder as defined in claim 12, wherein said elongated platform member and said handle support member are integrally molded.

* * * * *